US007178457B2

(12) United States Patent
Kristel

(10) Patent No.: US 7,178,457 B2
(45) Date of Patent: Feb. 20, 2007

(54) FOIL LOOK PRINTING TECHNIQUE

(75) Inventor: Ira Kristel, Manhasset, NY (US)

(73) Assignee: Commercial Envelope Manufacturing Co., Deer Park, NY (US)

( * ) Notice: Subject to any disclaimer, the term of this patent is extended or adjusted under 35 U.S.C. 154(b) by 0 days.

(21) Appl. No.: 10/874,467

(22) Filed: Jun. 23, 2004

(65) Prior Publication Data

US 2005/0284312 A1 Dec. 29, 2005

(51) Int. Cl.
*B31F 1/07* (2006.01)
*B65B 61/02* (2006.01)

(52) U.S. Cl. ..... 101/32; 101/6; 53/411

(58) Field of Classification Search ..... 101/3.1–32; 53/411
See application file for complete search history.

(56) References Cited

U.S. PATENT DOCUMENTS

| | | | | | |
|---|---|---|---|---|---|
| 3,320,876 | A * | 5/1967 | Salvatore | 101/23 |
| 4,588,390 | A | 5/1986 | Heitele et al. | |
| 4,737,329 | A * | 4/1988 | Rakoczy | 264/132 |
| 4,779,355 | A | 10/1988 | Petros | |
| 4,838,162 | A * | 6/1989 | Horton et al. | 101/296 |
| 5,150,560 | A * | 9/1992 | Crowley | 53/411 |
| 5,182,063 | A * | 1/1993 | Lang et al. | 264/132 |
| 5,250,018 | A | 10/1993 | Chung et al. | |
| 5,409,441 | A | 4/1995 | Muscoplat | |
| 5,638,752 | A * | 6/1997 | Hartung et al. | 101/177 |
| 5,672,381 | A * | 9/1997 | Rajan | 427/198 |
| 5,716,312 | A | 2/1998 | Kristel | |
| 5,752,442 | A * | 5/1998 | Johnson et al. | 101/211 |
| 5,873,305 | A * | 2/1999 | Dell'olmo | 101/32 |
| 5,897,733 | A | 4/1999 | Stevens | |
| 5,904,030 | A | 5/1999 | Kavanagh | |
| 5,912,682 | A | 6/1999 | Parkos | |
| 5,960,607 | A | 10/1999 | Bohn et al. | |
| 6,042,888 | A | 3/2000 | Sismanis et al. | |
| 6,067,103 | A | 5/2000 | Ewert et al. | |
| 6,070,391 | A | 6/2000 | Honegger | |
| 6,073,421 | A | 6/2000 | Lee | |
| 6,152,621 | A | 11/2000 | Langan | |
| 6,248,198 | B1 * | 6/2001 | Yen | 156/209 |
| 6,319,349 | B1 * | 11/2001 | Lin | 156/209 |
| 6,387,201 | B1 * | 5/2002 | Stuart et al. | 156/234 |
| 6,443,058 | B1 * | 9/2002 | Stadler et al. | 101/23 |
| 6,694,873 | B1 * | 2/2004 | LaBelle et al. | 101/23 |
| 6,718,871 | B1 * | 4/2004 | Fritz | 101/3.1 |
| 6,739,253 | B2 * | 5/2004 | Schaum | 101/232 |

OTHER PUBLICATIONS

Brochure, "ROLLAMATIC High Speed Web Machine, model RO," F.L. Smithe Machine Co., Inc. 1993.
Brochure, "One Man . . . One Press," Flexotecnica s.r.l., date unknown (prior art).

(Continued)

*Primary Examiner*—Ren Yan
(74) *Attorney, Agent, or Firm*—Lerner, David, Littenberg, Krumholz & Mentlik, LLP

(57) ABSTRACT

A process of manufacturing envelopes and a product manufactured in accordance with such process is disclosed. The process requires printing of an ink design on an envelope, coating of the ink design with a varnish and subsequently embossing the combined ink and varnish design so that a foil look is obtained on the envelope.

16 Claims, 6 Drawing Sheets

OTHER PUBLICATIONS

Brochure, "SC8 Narrow Web—One Man . . . One Press," Flexotecnica s.r.l., date unknown (prior art).

Brochure, "Flexotecnica presents the Tachys," Flexotecnica s.r.l., date unknown (prior art).

Brochure, "W&D Helios 202.00," Winkler & Dunnebier, Aug. 1993.

Brochure, "W&D Neu-New," Winkler & Dunnebier, Apr. 1995.

Brochure, "W&D Druckstock HEXAFLEX, Printing Stand HEXAFLEX," Winkler & Dunnebier, Jan. 1996.

* cited by examiner

FOIL LOOK PRINTING TECHNIQUE

FIELD OF THE INVENTION

The present invention relates to manufacturing of envelopes. More particularly, the present invention relates to printing on envelopes, either before or after the desired envelope shape is formed, as part of the envelope manufacturing process.

BACKGROUND OF THE INVENTION

Marketing of a company's products or services is often the most important part of a business. If a company is not effective at marketing its products or services, it usually will not remain in business for very long. Direct mailing is one marketing technique that is widely used in many industries, particularly in the financial industry by banks and other lending companies to solicit consumers to agree to use certain credit cards. In this regard, many million envelopes are sent by companies to potential consumers every day soliciting business from consumers.

In order for direct mailing to be effective, it is imperative that the business solicitations be read by a certain portion of the recipients that they are sent to. It is not an easy task to convince recipients of unsolicited envelopes to open such envelopes and read the contents In order to accomplish this task, it is important for the envelopes in which the business solicitations are sent to have interesting and attractive designs that will encourage potential customers to open the envelopes and learn more about the solicitation inside.

While the quality of print applied to envelopes as part of the manufacturing procedure has greatly improved in recent years, there remains a substantial need to further improve the print quality and to create interesting images on envelopes. One approach has been to apply gold or silver foil on envelopes in order to create a sophisticated high quality appearance that is attractive to potential customers. Such foil ornamental envelopes may be used by certain banks or credit facilities to advertise their Gold or Platinum brand credit cards. While existing foil printing techniques result in attractive and interesting products, it is a relatively expensive and slow process that is largely unacceptable to meet many high volume low cost commercial demands.

It is believed that Commercial Envelope Manufacturing Co. has developed the highest quality and cost efficient printing techniques known in the industry. Notwithstanding such developments and the efforts of Commercial Envelope and other companies to improve upon printing techniques, a need continues to exist for improvements in this area. The present invention solves the aforementioned shortcomings of prior art envelope manufacturing processes.

SUMMARY OF THE INVENTION

One aspect of the present invention relates to a process of manufacturing envelopes. The process comprises feeding a web of paper into an envelope manufacturing machine. A design made of ink is then printed at a selected area on the paper. A varnish coating is then printed on the design. It is desirable to then emboss the design at the selected area of the paper so that the design becomes raised above nonembossed areas of the paper. Optionally, the paper is then folded and glued at selected areas to form an envelope. In a preferred embodiment, the paper is also cut during the envelope manufacturing process. It is preferable and highly advantageous to integrate all of the foregoing into an in-line process It may be desirable to dry the ink after it is printed on the paper prior to performing the embossing step. It is also preferable to perform a drying process to dry the varnish coating prior to performing the embossing step.

In one embodiment, the folding and gluing steps may be performed after the printing and embossing steps are performed. In another embodiment, the folding and gluing steps may be performed prior to the printing and embossing steps. This later embodiment may be used where the envelope body is first created and the printing, varnish and embossing steps are later performed.

Preferably, the ink comprises a metallic ink so that a foil look is obtained after the embossing step is performed. In another preferred embodiment, the printed design comprises selected letters or numbers and the ink comprises multiple colors arranged adjacent to each other in the same letter or number so that a multicolored or rainbow appearance is obtained.

It is preferable for the step of printing ink to comprise a flexographic printing technique. However, lithographic, gravure or other printing techniques may also be used within the scope of the present invention.

Envelopes manufactured in accordance with a preferred process may be manufactured using an envelope manufacturing machine having an in-line printing and embossing process. Such an envelope manufacturing machine may include a paper feeding section (such as that adapted to receive a web of paper from a continuous roll), a printing section, a drying section, an embossing section, a cutting section, a folding section and a gluing section. The various sections of the performed envelope manufacturing machines need not be arranged in any particular order. Further, additional sections other than those discussed above may be used in accordance with preferred envelope manufacturing machines.

In accordance with a further aspect of the present invention, an envelope having a desired structure is provided. Such an envelope comprises a paper body and an ink design printed on the body. A varnish coating may be arranged on the ink design. The varnish coating may provide a desired "luster" (i.e., shine) to the ink design. If it is desired to increase the luster of the design, additional varnish coatings may be applied. The preferred envelope would also be embossed at the design so that the entire design, or a desired portion thereof, is raised above nonembossed portions of the envelope.

In a preferred embodiment, the ink comprises a metallic ink. The colors of the metallic ink may vary widely within the scope of the present invention, preferred colors include silver, gold and bronze.

The combination of metallic ink with a varnish and raised embossed areas create a foil look similar to the look obtained when true silver or gold foil is inlaid or embossed on the surface of a paper envelope. However, the present invention, which may include in-line printing and embossing sections of an envelope manufacturing machine to manufacture the desired envelopes, has substantial advantages over prior art foil printing techniques in terms of speed and cost. For example, the present printing technique can be used to manufacture the preferred envelopes of the present invention at speeds of greater than 1000 envelopes per minute at substantially reduced costs.

As used herein, the term manufacturing of envelopes is intended to include printing and embossing of the envelopes. It also includes the steps required to manufacture envelopes without printing and embossing such as receiving a continuous web of paper, cutting, folding and gluing of the paper to form the envelope body and stacking of the envelopes after they are manufactured.

As used herein, the term "design" is intended to include any printed image including, but not limited to letters, numbers, shapes, pictures, etc.

The foregoing features and advantages of the present invention will be more clearly understood when considered in conjunction with the following description and drawings.

DETAILED DESCRIPTION

Figure 1A:
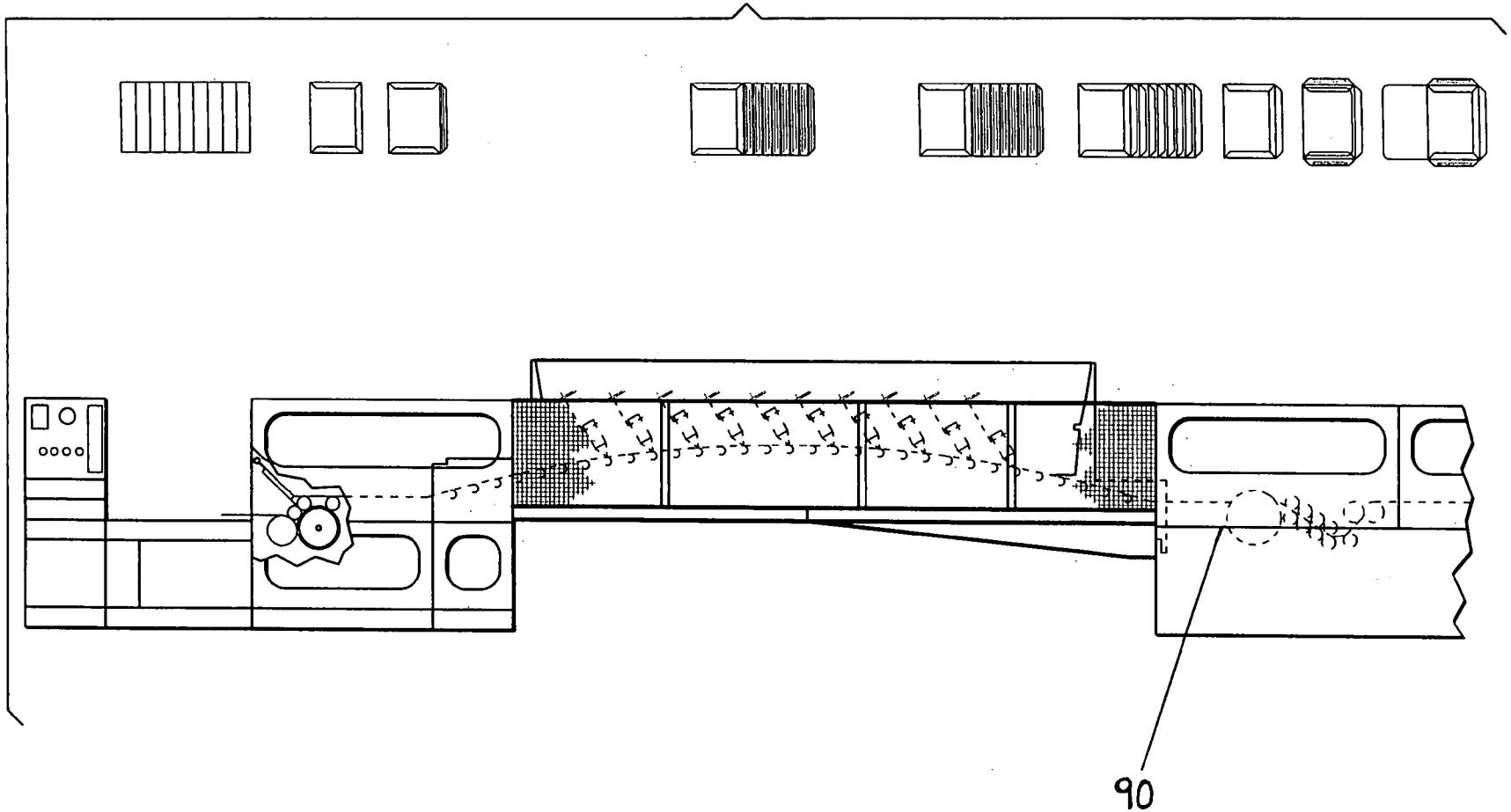
FIGS. 1A and 1B are schematic views of an envelope manufacturing machine in accordance with the present invention.
Figure 1B:
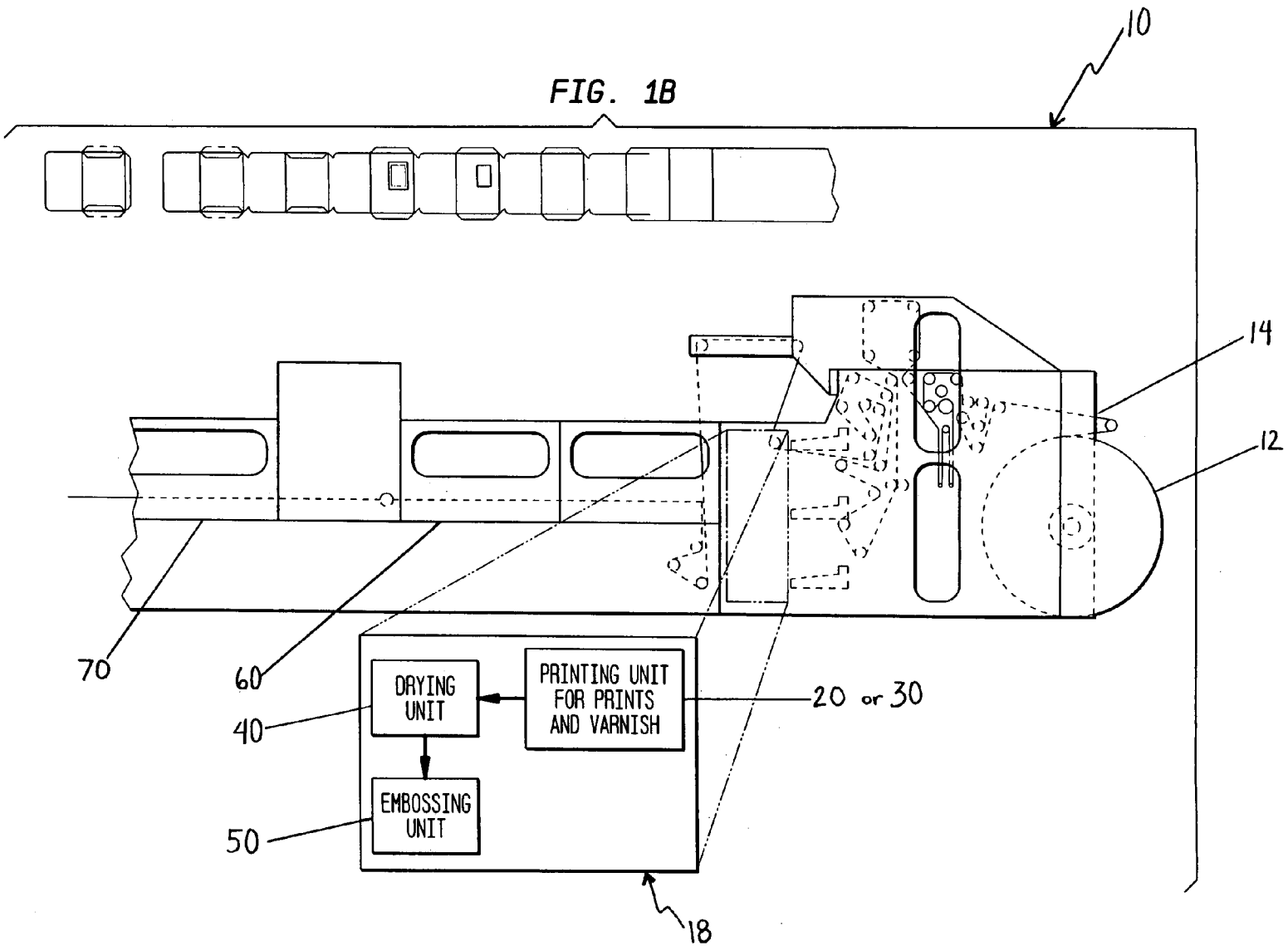

A process of manufacturing envelopes in accordance with the present invention is shown FIGS. 1A and 1B. FIGS. 1A and 1B show an envelope manufacturing machine 10 which is operative to process envelope paper 100 from a web of paper 12. Envelope manufacturing machine includes a paper feeding section 14, a foil-look section 18, a cutting section 60, a folding section 70 and a gluing section 90. Paper feeding section is operative to feed the paper from web of paper 12 to the rest of envelope manufacturing machine 10. Cutting section 60 is provided to cut envelope paper 100, folding section 70 to fold envelope paper 100 and gluing section 90 to glue envelope paper 100.

Foil-look section 18 is preferably inserted in-line with envelope manufacturing machine 10, before cutting section 60, folding section 70 and gluing section 90. Alternatively, foil-look section 18 may be inserted in-line after cutting section 60, folding section 70 and gluing section 90. Foil-look section 18 comprises a printing stage, a varnish stage and an embossing stage described below. The printing and varnish stages can incorporate various types of known printing techniques and may be accomplished in printing unit 20 or 30. The embossing stage occurs in embossing unit 50.

A drying section 40 may also be inserted after the printing stage or after the varnish stage. Inserting the drying section 40 after the printing stage is especially useful for printing-type inks that require drying or for paper types that require additional assistance to dry inks printed thereon. Drying after the varnishing stage can also be desirable, especially where several layers of varnish are applied during the manufacturing process. Increasing the number of varnish coatings is desirable to increase the luster or shine of the ink design. Alternatively, drying section 40 may be inserted after both the printing and varnishing stages. The drying section 40 may comprise a conventional-type drying unit as commonly used in the industry, units such as the drying units manufactured by the DEC-A-TEC Company.

Figure 2A:
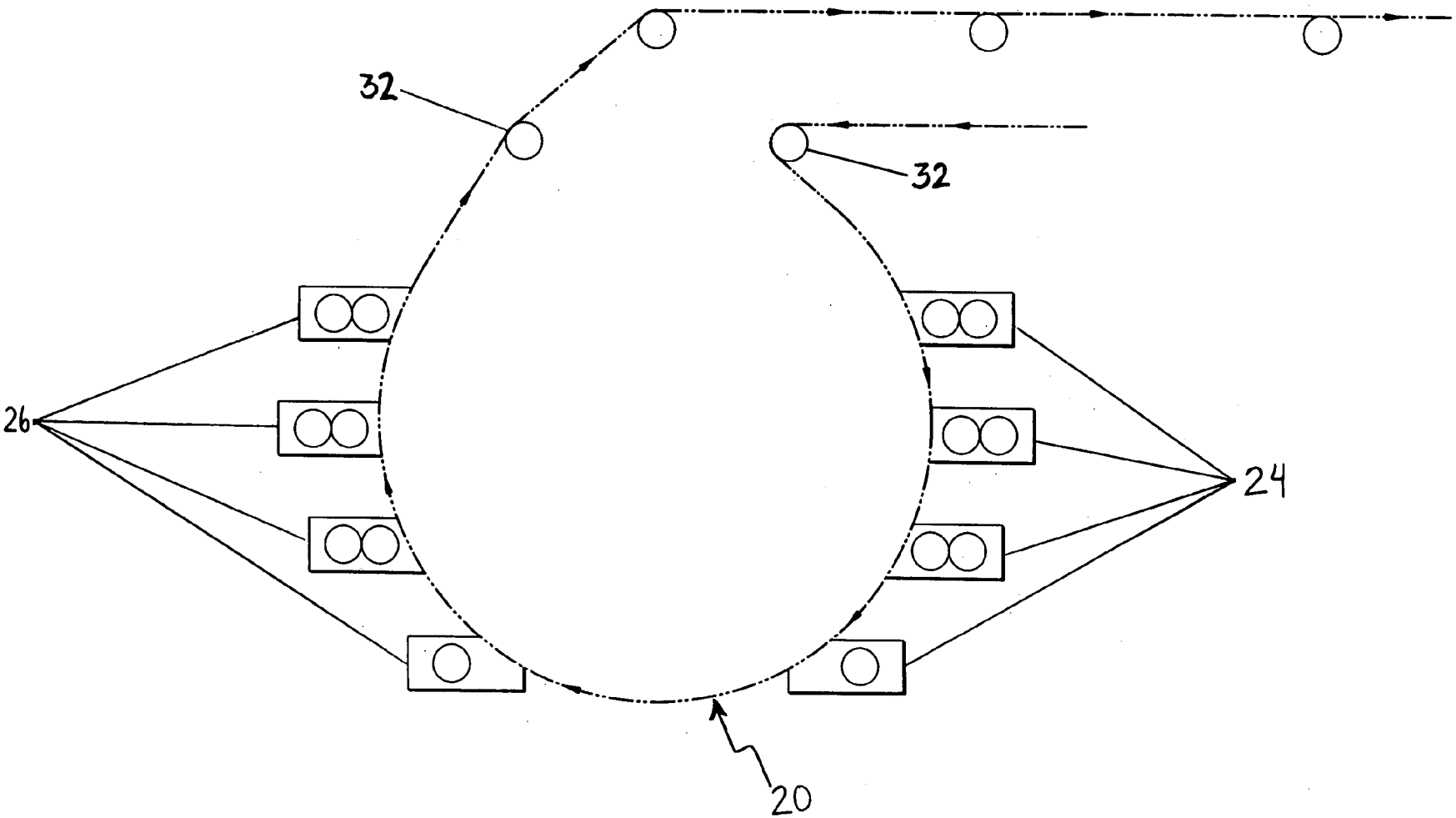
FIG. 2A is a schematic view of one embodiment of a printing unit of the envelope manufacturing machine of FIG. 1.
Figure 2B:
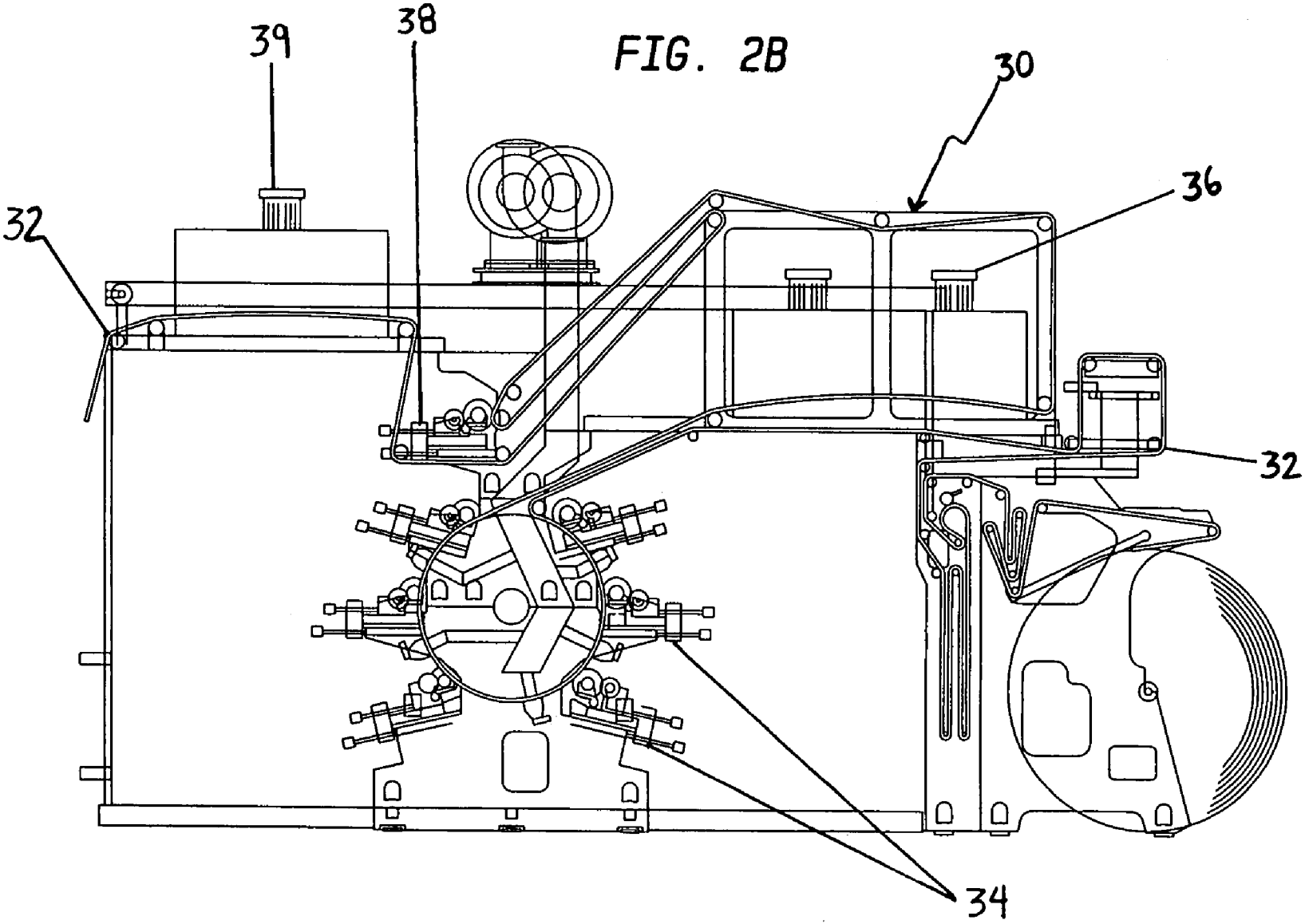
FIG. 2B is a schematic view of a second embodiment of a printing unit, of the envelope manufacturing machine of FIG. 1

The present invention can incorporate various types of printing techniques as shown in FIGS. 2A and 2B. FIG. 2A comprises one particular printing technique in printing section 20 of foil-look section 18. The printing technique shown in FIG. 2A shows one way to complete the printing stage and varnishing stage of foil-look section 18. Printing section 20 contains printing press ink heads 24 for printing an ink design upon envelope paper 100, and printing press varnish heads 26 for spraying varnish on top of the printed ink design. Printing section 20 also includes conventional cylinders 32 that guide paper traveling into and out of printing section 20.

FIG. 2B comprises another printing technique that may be used with the method of the present invention. Printing section 30 shown in FIG. 2B shows an alternative way to complete the printing and varnishing stage of foil-look section 18. Printing section 30 comprises outside printing flexographic printing heads 34 for printing an ink design on the outside of envelope paper 100. Printing ink by way of a flexographic printing technique is a common method known in the industry. It should also be noted that lithographic, gravure or other printing techniques may be used within the scope of the present invention. Printing section 30 also includes an outside printing drying system 36 for drying the outside printed ink design, a plurality of inside printing flexographic printing heads 38 for printing an ink design on the inside of the envelope paper and inside printing drying system 39 for drying the inside ink design. Printing section 30 is also comprised of a plurality of conventional cylinders 32 that guide the paper into the printing section 30 and then guide the paper out of the printing section 30 to the rest of the steps included in the present invention.

Figure 3:
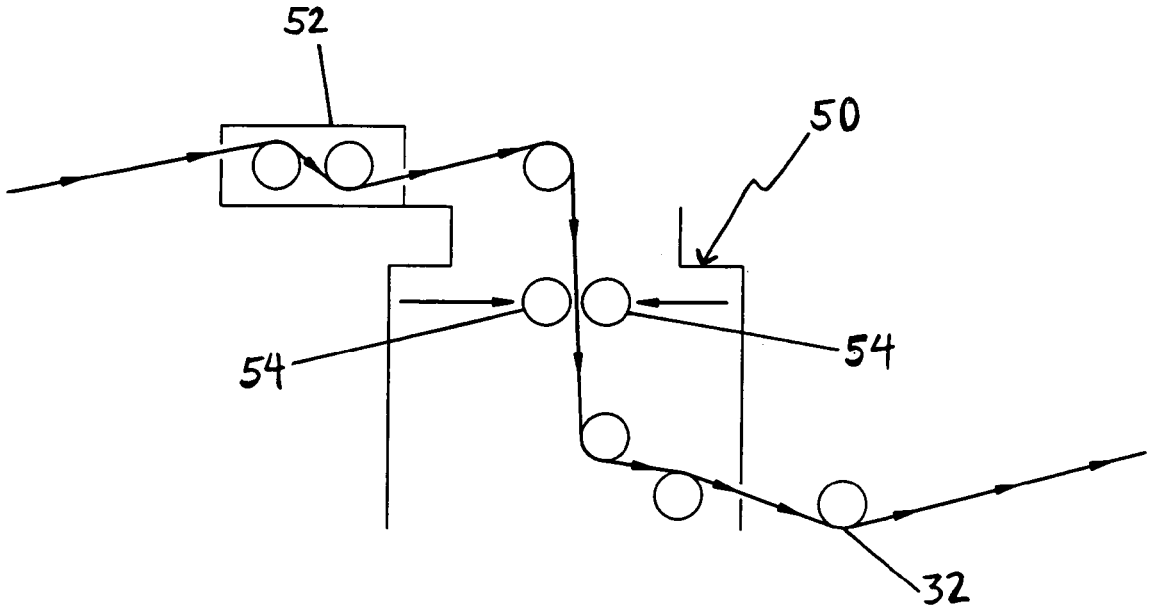
FIG. 3 is a schematic view of an embossing unit of the envelope manufacturing machine of FIG. 1.

FIG. 3 is a schematic view of embossing section 50 of envelope manufacturing machine 10. The embossing stage of foil-look section 18 is achieved in embossing section 50. Embossing section 50 comprises an edge guide 52 that properly aligns paper entering embossing section 50 received from previous stages of foil-look section 18. Embossing section 50 also includes conventional cylinders 32 to further align paper from edge guide 52 and embossing cylinders 54. Embossing cylinders 54 emboss paper after the printing and varnishing stages so that the ink design with varnish on top of the ink design created during said stages is raised above the non-embossed areas of envelope paper 100. Additional conventional cylinders 32 are included in the embossing section 50 to guide envelope paper 100 from the embossing cylinders 54 to the rest of the steps in the present invention.

Figure 4:
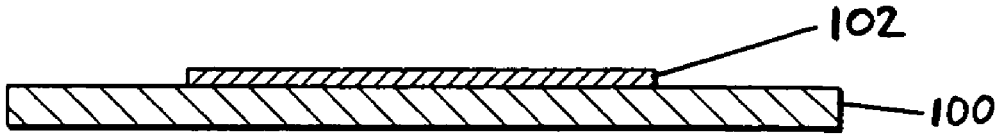
FIG. 4 is a schematic cross sectional view of a portion of an envelope with ink printed thereon.

A cross-sectional view of a portion of envelope paper 100 with a printed ink design 102 printed thereon is shown in FIG. 4. The ink may comprise metallic ink so that a foil look is obtained after envelope paper 100 leaves embossing section 50. The metallic ink preferably includes a color selected from the group consisting of gold, silver, and bronze. The printing stage accomplished by the printing techniques such as in printing section 20 or printing section 30 may be performed with such metallic ink. Alternatively, the ink may comprise multiple colors arranged adjacent to each other within printed ink design 102 so that a multi-colored or rainbow appearance is obtained. The printing stage accomplished by the printing techniques in printing section 20 or printing section 30 may be performed with such ink comprising multiple colors.

Figure 5:
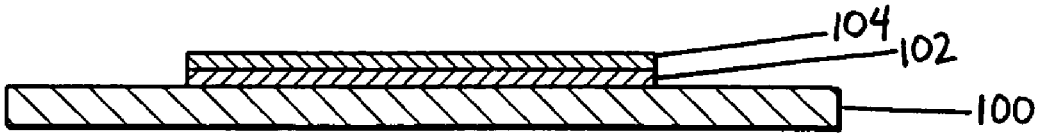
FIG. 5 is a schematic exaggerated cross sectional view of the portion of an envelope with ink and varnish printed thereon.
Figure 6:
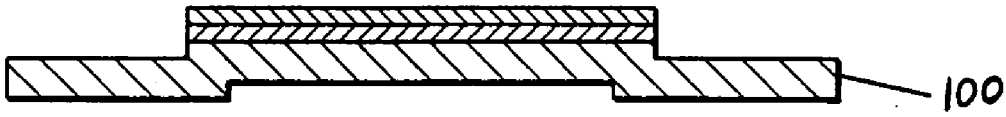
FIG. 6 is a schematic cross sectional view of a portion of an envelope with ink and varnish printed thereon and after it has been embossed in accordance with the present invention.

FIG. 5 displays an exaggerated, cross-sectional view of a portion of envelope paper 100 with printed ink design 102 and varnish coating 104 thereon. FIG. 6, shows an exaggerated, cross-sectional view of a portion of an envelope paper 100 with a printed ink design 102 and varnish coating 104 after it has been embossed. The portion of paper envelope 100 will appear as shown in FIG. 6 after leaving foil-look section 18.

Figure 7:
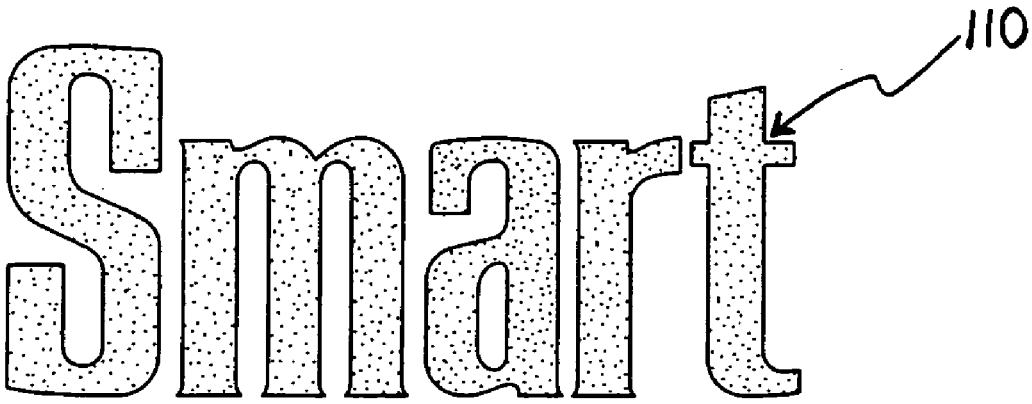
FIG. 7 is a plan view of a word design created on a portion of an envelope in accordance with the present invention.

Finally, FIG. 7 illustrates a printed ink word design 110 created in accordance with the present invention. Printed ink design 102 may be comprised of any form, logo, design, etc. and may include letters and/or numbers.

The preferred in-line arrangement of the present invention allows for a complete envelope manufacturing procedure wherein the envelopes are printed, embossed, cut, folded, and glued. Such an in-line arrangement has several advantages over prior techniques which are relatively expensive and increase the time necessary to manufacture high quality and attractive envelopes. For example, incorporating the components of the foil-look section in-line with the manufacturing machine eliminates the need for blank manufactured envelopes to be sent to another location to be printed upon. Thus, the cost of completing both printing and manufacturing of envelopes in one process is significantly less than manufacturing the envelopes and then paying transportation and printing costs to send the envelopes to an alternate location. Also, the time involved in printing and manufacturing an envelope in one process is considerably less than the time involved in manufacturing the envelopes, sending the envelopes out, printing on each envelope, sending the envelopes back to the envelope manufacturer, and then subsequently sending out the finished envelopes to the party that ordered the envelopes.

While the present invention has been described with reference toward the preferred embodiments, it will be apparent that numerous variations and modifications can be without departing from the spirit and the scope of the present invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A process of manufacturing envelopes comprising:

feeding a web of paper into an envelope manufacturing machine;

printing a design made of ink on said paper;

printing a varnish coating only on said design;

embossing said paper at said design after the varnish coating has been printed thereon so that said design is raised above nonembossed areas of said paper; and folding and gluing said paper to form an envelope.

2. The process of claim 1 further comprising drying said varnish prior to embossing said paper.

3. The process of claim 1 wherein said folding and gluing of said paper is performed after said printing and embossing steps.

4. The process of claim 1 wherein said folding and gluing of said paper is performed prior to said printing and embossing steps.

5. The process of claim 1 wherein said step of printing ink comprises a flexographic printing technique.

6. The process of claim 1 further comprising cutting said web of paper prior to certain of said folding and gluing steps.

7. The process of claim 1 wherein said ink comprises metallic ink so that a foil look is obtained after said embossing step is performed.

8. The process of claim 1 wherein said ink comprises multiple colors arranged adjacent to each other within said design so that a multi-colored or rainbow appearance is obtained.

9. A process of manufacturing envelopes comprising:

providing an envelope manufacturing machine including a paper feeding section, a printing section, a drying section, an embossing section, a cutting section, a folding section and a gluing section;

feeding a web of paper through said paper feeding section;

printing a design made of metallic ink at a selected area on said paper;

printing a varnish coating only on said design; and embossing said design at the selected area after the varnish coating has been printed thereon so that said design is raised above nonembossed areas of said paper whereby said design obtains a foil look.

10. The process of claim 9 wherein said metallic ink includes a color selected from the group consisting of gold, silver and bronze.

11. The process of claim 9 further comprising the step of drying said metallic ink as said paper passes through said drying section of said envelope manufacturing machine.

12. The process of claim 9 further comprising the step of drying said varnish as said paper passes through said drying section of said envelope manufacturing machine.

13. The process of claim 12 further comprising cutting, folding and gluing preselected areas of said paper after completion of said printing and embossing steps.

14. The process of claim 12 further comprising cutting, folding and gluing selected areas of said paper prior to completion of at least one of said printing and embossing steps.

15. The process of claim 9 wherein printing of said metallic ink is performed using a flexographic printing technique.

16. The process of claim 9 wherein said design comprises selected letters or numbers.

* * * * *